United States Patent [19]

Obligio

[11] Patent Number: 4,799,666

[45] Date of Patent: Jan. 24, 1989

[54] AMUSEMENT DEVICE HAVING CONTROLLED EXPLOSIVE SURFACES

[75] Inventor: Luis E. Obligio, Buenos Aires, Argentina

[73] Assignee: Omranco International Corporation, Agoura, Calif.

[21] Appl. No.: 3,485

[22] Filed: Jan. 15, 1987

[51] Int. Cl.[4] ..... F42B 4/04

[52] U.S. Cl. ..... 272/8 N; 102/335; 102/361; 273/58 R; 446/398

[58] Field of Search ..... 272/8 N, 20, 1 R, 27 R, 272/27 N; 102/335, 360, 361; 446/398; 273/58

[56] References Cited

U.S. PATENT DOCUMENTS

| | | | |
|---|---|---|---|
| 175,360 | 3/1876 | Linton | 102/335 |
| 674,052 | 5/1901 | Bacci | 446/398 |
| 1,253,597 | 1/1918 | Hitt | 102/361 X |
| 1,455,097 | 5/1923 | Van Doren | 102/360 |

FOREIGN PATENT DOCUMENTS

| | | | |
|---|---|---|---|
| ARI 2340 | 11/1986 | Argentina . | |
| 1685 | of 1888 | United Kingdom | 102/335 |
| 2078352 | 1/1982 | United Kingdom | 102/361 |

*Primary Examiner*—David A. Scherbel
*Assistant Examiner*—Richard E. Chilcot, Jr.
*Attorney, Agent, or Firm*—Poms, Smith, Lande & Rose

[57] ABSTRACT

An amusement device comprises two ball members. One or both have a hard surface coated with a material that explodes when it impacts with another ball at the site of the impact. The coatings comprises by weight to the weight of the coating before application to the ball members 62%–65% of potassium chlorate as an oxidant, 12%–15% amorphous sulphur as a combustible, 10% and 14% each by weight of casein glue as and inhibitor adhesive and arabic gum as and adhesive inhibitor. The coating also includes approximately 1% by weight of a sodium or calcium carbonate compound to act as a neutralizer. The ball members are made of a non-vitrified porcelain, about 1 inch in diameter and have a maximum porosity of 3%.

12 Claims, 1 Drawing Sheet

AMUSEMENT DEVICE HAVING CONTROLLED EXPLOSIVE SURFACES

BACKGROUND OF THE INVENTION

1. Field of Invention

This invention relates to an amusement device having two or more balls, at least one of which has a surface coating that is a controlled explosive. When two balls make sharp contact with each other, a small area of the explosive on one surface region on at least one of each of the balls explodes in a small, controlled explosion.

2. Description of the Prior Art

Small percussion caps have been common in certain types of children's toys for mimicking the sound of small explosions, such as the explosion that occurs when a bullet fires. The choice of materials for percussion caps and the technology for constructing them is well known.

One of the drawbacks of caps is that the exploding material is held between two long strips of paper or other flexible material. After the cap is used, the paper remains. It is a source of litter. It is also difficult to control precisely the amount of explosive in each cap so that some caps may not explode and others explode excessively.

An object of the present invention is to disclose and provide an amusement device utilizing a small explosion or deflagration, which takes place on the surface coating of one or more hard balls. A further object of the present invention is to disclose and provide a method for making the balls such that the rate of explosion is controlled and is uniform.

SUMMARY OF THE INVENTION

The present invention uses two ball members, each approximately one inch in diameter. The balls are made of a non-vitrified porcelain, similar to those used in exchange towers. Through a dipping process, the balls are coated with a mixture that includes an oxidizing agent such as potassium chlorate and a combustible material such as amorphous sulphur. Adhesives and inhibitors act to bind the coating to the surface of the ball and to control the explosion.

A game may be played using two balls in which one ball is thrown into the air and caught in one's hand holding the other ball so that both balls strike each other. A small detonation takes place at the point of contact between the two balls. Because of the relatively large surface area of the balls and the fact that only a small amount of coating explodes on each impact, the balls may be banged together many times and still cause a small explosion.

DETAILED DESCRIPTION OF THE PREFERRED EMBODIMENT

Figure 1:
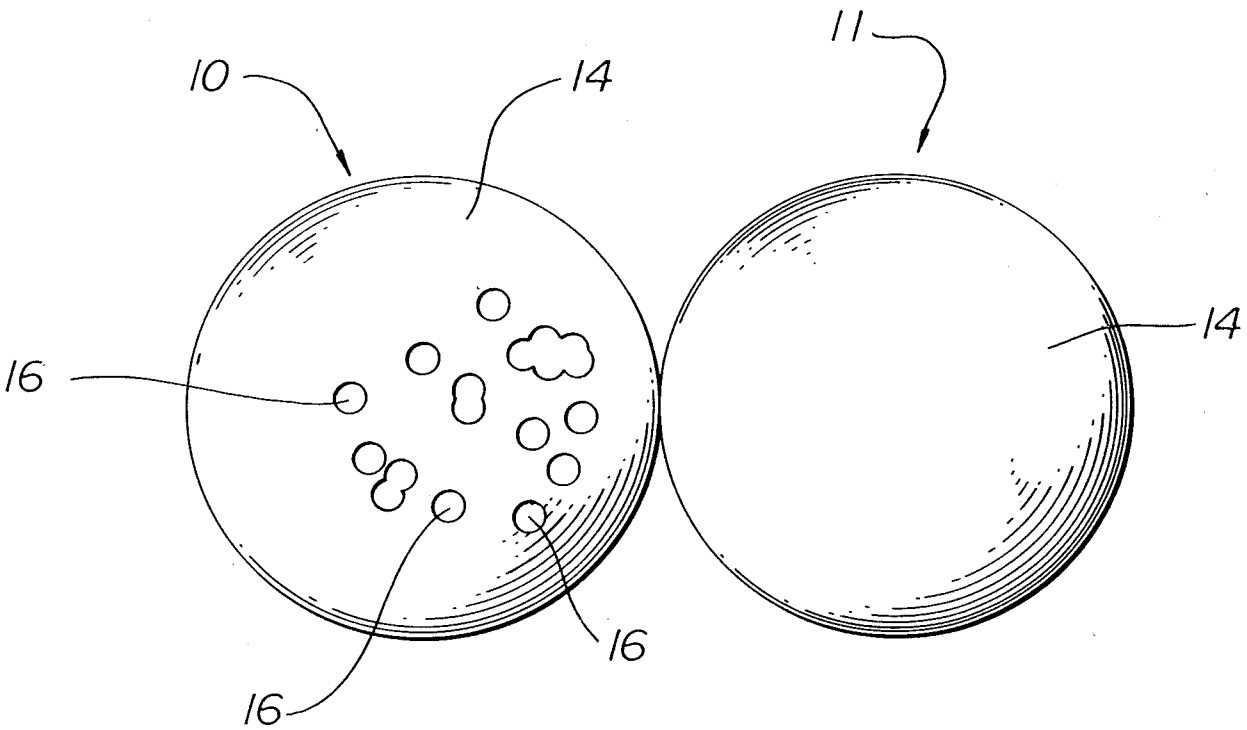
FIG. 1, the only FIGURE, is a plan view of the two balls of the amusement device of the present invention.

The amusement device of the present invention comprises at least two ball members 10 and 11. In the exemplary embodiment, the balls are spherical, but ovoidal shaped are also acceptable. Spherical balls of the type used are readily available. In the exemplary embodiment, the balls are formed of non-vitrified porcelain material. This type of sphere is relatively standard and is of general use in exchange towers. They are also used for grinding and homogenizing cosmetics. A one inch (2.5 cm) diameter is recommended. Two one inch spheres adjacent to each other fit well in the palm of one's hand.

It is best for coating if the external surface of each sphere is without irregularity and slightly rough. Although white porcelain is the best material for the spheres, other ceramic balls such as those made by the dry method with red clay, have also rendered acceptable results. They require some modification to the explosive coating.

At least one of the ball members 10 and 11 is coated with a material that can explode on impact. In the exemplary embodiment, both ball members 10 and 11 are coated with the material. The remainder of the discussion will assume that both are coated. Coating 14, once dry and firmly adhering to balls 10 and 11, consist of a very homogenous dispersion of several components. The proportion of the components can vary within fairly narrow limits according to the material from which the balls 10 and 11 are constructed and the desired sound level of the detonation. In the exemplary embodiment, the coating comprises an oxidant, a combustible material an inhibitor and an adhesive. Other materials may also be included.

The oxidant is preferably an alkali metal chlorate, preferably potassium chlorate $KClO_3$. The potassium chlorate comprises between 62% and 65% by weight of the coating. Potassium chlorate is advantageous because it is not hydroscopic. The coating is acceptably resistent to room humidity.

The combustible material is amorphous sulphur. It comprises between 12% and 15% by weight of the final coating. Amorphous sulphur does not dissolve in the aqueous mixture that form the coating. It is dispersed and trapped by the adhesive colloids. The colloid protects the particles. The sulphur increases the impact sensitivity. As a result, the percentage of sulphur cannot be increased significantly.

Means are provided for inhibiting the deflagration and for causing the coating to adhere to the outside surface of the ball members. In the exemplary embodiment, the mixture that forms the coating includes casein glue, 10%–14% by weight, arabic gum, between 10% and 14% by weight and white dextrin, between 1% and 2% by weight. It is known that adding glues and gums to pyrotechnical compositions depresses deflagration. The amount of glues and gums added to the composition used in the present invention permits detonation to occur immediately at impact even when the coating is applied in very thin layers, but the inhibitors prevent deflagration spreading to adjacent areas. Therefore, deflagration is kept to relatively small areas such as areas 16.

Casein glue is somewhat costly. Its advantage is that upon drying, it can produce a thin coating without discontinuity. Casein glue has a very limited inhibiting action. If it alone were used, the coating would be too sensitive for exploding due to friction. By combining the casein glue with arabic gum, one obtains a balanced coating. White dextrin which is also an adhesive, is better dispersed in the colloidal suspension than the other elements. It contributes to an improved flow of the mixture over the surface of the balls and results in a more uniform thickness of the coating.

Varying the relative proportions of the three adhesive inhibitor elements varies the sensitivity of the coating and its adherence and flow to the surface of the balls. It is possible to use replacement materials by providing for proper proportions.

Normally, the mixture will be colored for aesthetic reasons. The proportion of the color varies depending on the color chosen so that the final color is as desired. Excess color affects the flow of the mixture and may form a surface film during drying.

In order to utilize the gums and glues of the exemplary embodiment, the coating must be applied wet as a colloidal suspension and allowed to dry. The particles must be sufficiently micronized, so that the coating can be made satisfactorily homogenous with thorough mixing. Including dextrin, arabic gum and casein glue during the mixing process also acts to prevent the active components of the suspension, chlorate and sulphur, from interacting during the mixing.

The casein glue, arabic gum and white dextrin are also useful in the proper proportions when applied as aqueous colloidal suspension is effective in obtaining firm adhesion of the coating to the slightly rough surface of the balls. The casein glue has a relatively limited inhibiting effect on deflagration. The arabic gum reinforces the inhibiting action and also improves overall adhesivity. Dextrin in the small quantities used in the composition acts mainly as an extender when the suspension is being applied to the balls.

Purified animal glue can also be used, but the coating must have to be applied at a higher temperature. The various proportions of the compounds of the mixture also must be modified. Other adhesives such as vinyl glues have been tested with acceptable but somewhat inferior results.

Film thickness must be controlled for safety reasons and for correct performance. An excessively thick coating also increases the manufacturing costs. The preferred thickness of the coating should be approximately 0.3 mm±20%.

Three principal aspects affect safety. First, it is best to use the minimum amount of coating while still obtaining acceptable results because the chemicals are hazardous to handle. Second, more explosive detonates with each impact if the coating is excessively thick. A greater explosion increases the risk that the explosion can project non-ignited particles that surround the impact point. Third, if a child ingests the coating, the total potassium chlorate quantity remains under what is considered a dangerous dose.

A thicker coating may actually impede deflagration. An excessively thick coating acts as an elastic damper during the impact of the two balls together such that detonation may not occur unless the force is greatly increased.

From a practical point of view, it is also better to minimize the thickness of the coating because, by minimizing the area that is used during each impact, larger unused areas remain. This maximizes the total number of uses one can have with the same ball. Thinner films also dry quicker and speed the manufacturing process.

The coating takes place using a wet process of spreading the colloidal aqueous dispersant. The coating takes place at room temperature. These factors provide a safe manufacturing environment. For added safety, the whole procedure takes place using small batches. The potassium chlorate is neutralized using small amounts of sodium or calcium carbonate. The potassium chlorate is not mixed with the sulphur until both are dispersed separately, homogeneously in fine particles within an aqueous colloid, which the adhesives and inhibitors form.

Risks are minimized if the total aqueous mixture is less than 1.5 kg. To achieve a preferred batch size, the user separately weighs 520 g of crystalline potassium chlorate plus 5 g of sodium carbonate. 100 g of amorphous powdered sulphur is placed in a different container. A third container has 100 g of casein glue, 90 g of powdered arabic gum and 10 g of white dextrin, to which has been added 0.6 liter of cold water. The casein glue, arabic gum, white dextrin and water are mixed to remove all "clots." The speed of the mixer is made slow enough to prevent foam from forming. Five minutes of mixing is usually sufficient. One-half of the resulting liquid is poured into each of the two different vessels containing potassium chlorate and sulphur. The liquids in each of the containers are mixed slowly until there are no dry particles, either potassium chlorate or sulphur. The two colloidal suspensions are adequately mixed together only when all dry particles are absent in both containers and the liquid in each container is homogenous.

Coloring matter in the form of emulsified pigments, usually about 1%–2% by weight of the dry ingredients of the coating, may be added to the liquid to obtain the desired color for the coating.

The final mixture is then mixed together to obtain a homogenous colloidal suspension. Clean but dry balls are then submerged in the liquid in accordance with the capacity of the container. The balls are stirred in the liquid with a tool or with a gloved hand until the surfaces of the ball are completely inpregnated with the liquid. The balls are then removed and allowed to dry in frames made of wire netting. Chicken wire, having hexagonal orifices about 8 mm per side with 0.5 mm diameter wire supports the balls. Any excess dripping from the balls is collected in trays for reuse.

Interruptions in the mixing are permissable. Any delay of more than five to ten minutes requires additional mixing to avoid the denser components from precipitating. Once the coating of the spheres begins, the process should not be interrupted because premature hardening of the mixture could occur. That would result in an improper coating for the balls.

Viscosity and density of the coating bath varies within relatively strict limits. These factors may vary slightly if different compositions are used for the coating. Changing the viscosity and density too much results in an incorrect film thickness. The correct composition also avoids having the wire drying frame leave marks. If the fluid is too viscous, it will not flow over the balls and will leave drip marks on the bottom. Any drip marks that might remain should be removed because the explosion that would result because of impact at the drip marks would be greater than would otherwise occur in other regions of the ball.

Drying takes place indoors or outdoors. Forced air circulation especially with dehumidified air at 30° C. improves drying. It is desirable to allow the coated balls to remain in the drying racks even after the coating is dry because the coating undergoes a curing effect. Only after curing takes place should the balls be packed for storage.

To prevent contamination of the coating, strict procedures must be followed. Once the mixture is dry on any of the tools or containers, the tool or container must be cleaned and the resulting mixture properly disposed.

The drying frames and catch containers must be washed with water. Any collected material is burned.

Packaging should prevent the balls from contacting each other. Blister packs or similar packaging can separate two balls. It is best if the balls are kept out of direct sunlight, especially if they are in blister packs. Depending on the shape of the plastic holding the balls, there may be a possibility that the plastic will concentrate sunlight on some part of the surface of the ball and detonate that region. Packing should take place in a low-humidity environment. It is best if the packaging is relatively airtight to prevent exposure of the coating to high ambient humidity. Excess humidity negatively effects the detonation property of the mixture.

Some variation in the composition of the various elements of the present invention is permitted. If more porous balls are used, they are normally lower in density, lower in hardness and have a greater elasticity. The coating for these balls will have to be more sensitive. That is, the mixture will have a similar percentage of inhibitors and adhesives. Balls with a porosity of more than 3% or hardness below 6.5 Mosh require mixtures with adhesive percentages less than 20%. These mixtures are more flammable and may be unsafe. On the other hand, increased porosity makes adhesion of the coating easier. Impact of the balls together also produces a deeper, and more pleasant sound.

If the surface of the balls is vitrified (very smooth and shiny), it is more difficult for the mixture to adhere to the surface of the ball. The manufacturer risks having to use an excessive quantity of adhesive which acts as a greater inhibitor.

There are several ways to use the balls in a game or as an amusement. In one game, two of the balls are held in the user's hand. With a one inch size, two balls comfortably fit in a hand. The user throws one of the balls a short distance up in the air and catches the thrown ball so that it impacts the remaining ball in the same hand. The impact can be enhanced if the user moves the catching hand toward the ball being caught. Where the two balls impact, a small explosion takes place. The area of the explosion is opposite from the user's hand so the explosion is heard but the heat of the deflagration is not felt. It is also possible to use more than two balls. One ball could be thrown into the air by a user holding two remaining balls in his or her hand. The ball would be caught so that it impacts the two remaining balls simultaneously. Because the impact is spread over two balls, it may be necessary to increase the closing velocity between the two balls.

As another alternative, one could have different size balls and throw the smaller one against the larger one. The larger ball could even form a target, especially if the ball is replaced with a larger size object.

I claim:

1. An amusement device comprising:
   a. at least two ball members, at least one of the ball members having a hard surface and a coating of a material which can explode on impact with another ball member;
   b. the coating comprising an oxidant and a combustible for creating an explosion, an inhibitor for inhibiting the explosion to a localized area on the surface the ball members, and an adhesive for adhering the oxidant, the combustible, the inhibitor and the adhesive on the surface of the ball members;
   c. the adhesive and the inhibitor each comprises between 10% and 14% casein glue and arabic gum by weight to the weight of the coating.

2. The amusement device of claim 1 wherein the coating comprises by weight to the weight of the coating before application to the ball members 62%–65% of potassium chlorate as an oxidant, 12%–15% amorphous sulphur as a combustible, 10% and 14% each by weight of casein glue as an inhibitor adhesive and arabic gum as an adhesive inhibitor.

3. The amusement device of claim 2 further comprising approximately 1% by weight of a carbonate compound to act as a neutralizer.

4. The amusement device of claim 1 wherein the ball members comprise non-vitrified porcelain.

5. The amusement device of claim 4 wherein the ball members are about 1 inch in diameter.

6. The amusement device of claim 4 wherein the ball members have a maximum porosity of 3%.

7. A method of making an amusement device comprising:
   a. mixing a liquid which comprises by weight to the weight of the coating before application 62%–65% of potassium chlorate as an oxidant, 12%–15% amorphous sulphur as a combustible, and 10% and 14% each by weight of casein glue as an inhibitor adhesive and arabic gum as an adhesive inhibitor, the mixing step including a preliminary mixing step in which part of the casein glue and arabic gum are mixed in a first container with the potassium chlorate and another part of the casein glue and arabic gum are mixed in a second container with the sulphur, the contents of the first and second containers being mixed together after the mixture in each of the containers is homogeneous;
   b. coating a ball member having a hard surface with the liquid, removing the ball member from the liquid and allowing the liquid to dry.

8. A method of making an amusement device comprising:
   a. mixing a liquid which comprises by weight to the weight of the coating before application to the ball members 62%–65% of potassium chlorate as an oxidant, 12%–15% amorphous sulphur as a combustible, and 10% and 14% each by weight of casein glue as an inhibitor adhesive and arabic gum as an adhesive inhibitor, the mixing step including a preliminary mixing step in which part of the casein glue and arabic gum are mixed in a first container with the potassium chlorate and another part of the casein glue and arabic gum are mixed in a second container with the sulphur, the contents of the first and second containers being mixed together after the mixture in each of the containers is homogeneous,
   b. coating a ball member having a hard surface with the liquid, removing the ball member from the liquid and allowing the liquid to dry.

9. An amusement device comprising:
   a. two ball members, both ball members having a hard surface and a coating of a material which can explode on impact with the other ball member;
   b. the coating comprising an oxidant and a combustible for creating an explosion, an inhibitor for inhibiting the explosion to a localized area on the surface the ball members, and an adhesive for adhering the oxidant, the combustible, the inhibitor and the adhesive on the surface of the ball members;

c. the adhesive and the inhibitor each comprises between 10% and 14% casein glue and arabic gum by weight to the weight of the coating.

10. The amusement device of claim 9 wherein the adhesive and the inhibitor each comprises between 10% and 14% casein glue and arabic gum by weight to the weight of the coating.

11. The amusement device of claim 9 wherein the coating comprises by weight to the weight of the coating before application to the ball members 62%–65% of potassium chlorate as an oxidant, 12%–15% amorphous sulphur as a combustible, 10% and 14% each by weight of casein glue as an inhibitor adhesive and arabic gum as an adhesive inhibitor.

12. The amusement device of claim 11 further comprising approximately 1% by weight of a carbonate compound to act as a neutralizer.

* * * * *